US005186576A

United States Patent [19]

Fournier

[11] Patent Number: 5,186,576

[45] Date of Patent: Feb. 16, 1993

[54] BOAT HULL SUPPORT

[76] Inventor: Oscar A. Fournier, 10200 Gandy Blvd., Apt. 1018, St. Petersburg, Fla. 33702

[21] Appl. No.: 755,917

[22] Filed: Sep. 6, 1991

[51] Int. Cl.[5] ..... B63C 5/04

[52] U.S. Cl. ..... 405/7; 405/3

[58] Field of Search ..... 405/3, 4, 7

[56] References Cited

U.S. PATENT DOCUMENTS

| | | | |
|---|---|---|---|
| 1,407,375 | 2/1922 | Burbank . | |
| 1,515,435 | 11/1924 | Glover . | |
| 1,614,131 | 1/1927 | Johnson . | |
| 2,470,396 | 5/1949 | Guerette | 405/7 X |
| 3,139,277 | 6/1964 | Mears . | |
| 3,586,285 | 6/1971 | Modzelewski | 405/7 X |
| 4,155,667 | 5/1979 | Ebsen | 405/7 |
| 4,944,633 | 7/1990 | Robb | 405/3 |

FOREIGN PATENT DOCUMENTS

| | | | |
|---|---|---|---|
| 1036621 | 8/1983 | U.S.S.R. | 405/7 |
| 1232564 | 5/1986 | U.S.S.R. | 405/7 |
| 2092529 | 8/1982 | United Kingdom | 405/7 |

*Primary Examiner*—Randolph A. Reese
*Assistant Examiner*—J. Russell McBee

[57] ABSTRACT

The invention concerns a boat hull support that includes a pair of hull support members spaced from each other and each pivotally mounted intermediate its ends to spaced uprights. A guide post is mounted for vertical movement in the space between the support members, and sliding rods join the support members to the guide post so that vertical movement of the guide post will be translated into substantially equal movement of the support members about their pivots.

7 Claims, 1 Drawing Sheet

BOAT HULL SUPPORT

BACKGROUND OF THE INVENTION

This invention relates to a support for the hull of a boat, and particularly to a support in which the boat hull will center itself in the support.

Hull supports are required for supporting the boat while in dry storage or for holding the boat while it is placed into or withdrawn from the water. Ideally, hull supports will hold the hull such that the boat is upright and the keel is along the center line of the support. One of the simplest hull supports for dry storage is a series of timbers with brackets and wedges. More elaborate hull supports are found in U.S. Pat. Nos. 1,407,375 issued Feb. 21, 1922 to Burbank, 1,515,435 issued Nov. 11, 1924 to Glover, 1,614,131 issued Jan. 11, 1927 to Johnson, and 3,139,277 issued Jun. 30, 1964 to Mears.

The hull supports o the prior art require a trial and error effort to center the keel within the support. The hull support according to the present invention will automatically cause the keel to center itself within the support.

SUMMARY OF THE INVENTION

The invention concerns a boat hull support that includes a pair of hull support members spaced from each other and each pivotally mounted intermediate its ends to spaced uprights. A guide post is mounted for vertical movement in the space between the support members and means join the support members to the guide post so that vertical movement of the guide post will be translated into substantially equal movement of the support members about their pivots.

A keel of a hull which contacts either one of the support members at a position between the spaced uprights will deflect the support member downwardly thereby moving the guide post downwardly and causing the other support member to incline to substantially the same extent as the first contacted support member. The hull will then slide to the bottom of the V formed by the two inclined support members and will center itself.

The invention further resides in such a hull support in which the ends of the support members that are remote from the guide post are weighted so that the support members normally assume a horizontal position.

In the preferred embodiment, the support members are joined to the guide post by means of rods that are pivotally attached to the guide post at one end and slide blocks formed on the underside of the support members. The support members are preferably pivotally attached to the uprights by a joint that allows pivoting in two directions. The uprights may themselves be in the form of adjustable jacks so that the height of the hull support above its foundation can be varied.

It is principal object of the invention to provide a hull support that will mold itself to the various contours of the bottom of the boats and which will align the center line of the keel with the center of the support.

It is another object of the invention to provide a hull support that eliminates the need to center the keel in the support by trial and error.

The foregoing and other objects and advantages of the invention will appear in the following detailed description.

In the description reference is made to the accompanying drawing which illustrates a preferred embodiment of the invention.

DETAILED DESCRIPTION OF THE PREFERRED EMBODIMENT

Figure 2:
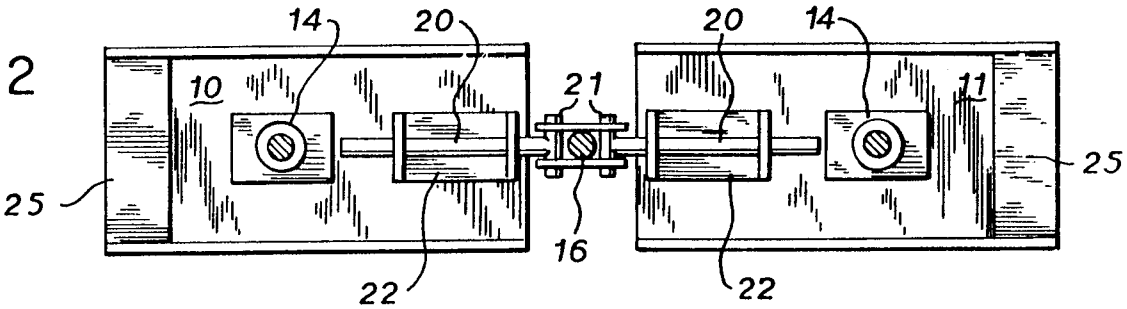
FIG. 2 is a bottom plan view of the hull support of FIG. 1 taken in the plane of the 2—2 in FIG. 1.

Referring to the drawing, the hull support includes a pair of support members 10 and 11 that are spaced from each other end to end and which are pivotally supported on a pair of spaced jacks 12. The support members 10 and 11 may be in the form of metal channels or a reinforced member with their web supporting a sliding surface such as a layer of plastic 13, or a roller surface. The support members 10 and 11 are mounted to the top of the jacks 12 by ball joints 14 which allow motion in all directions. The jacks 12 are supported in a foundation 15. The foundation 15 can be a platform suggested on the ground, in the air or on the forks of a fork lift.

A center guide post 16 is mounted in a sleeve 17 in the foundation 15 for the hull support. The guide post 16 can slide vertically in the sleeve 17. A pair of rods 20 are each connected at one end by a pivot 21 to the top of the guide post 16. The rods 20 are slidably received in blocks 22 formed by metal channels attached to the underside of the web of the support members 10 and 11. The flanges of the blocks 22 have aligned openings with bushings that receive the rods 20. The rods 20 operatively join the two support members 10 and 11 together through the vehicle of the guide post 16.

Figure 1:
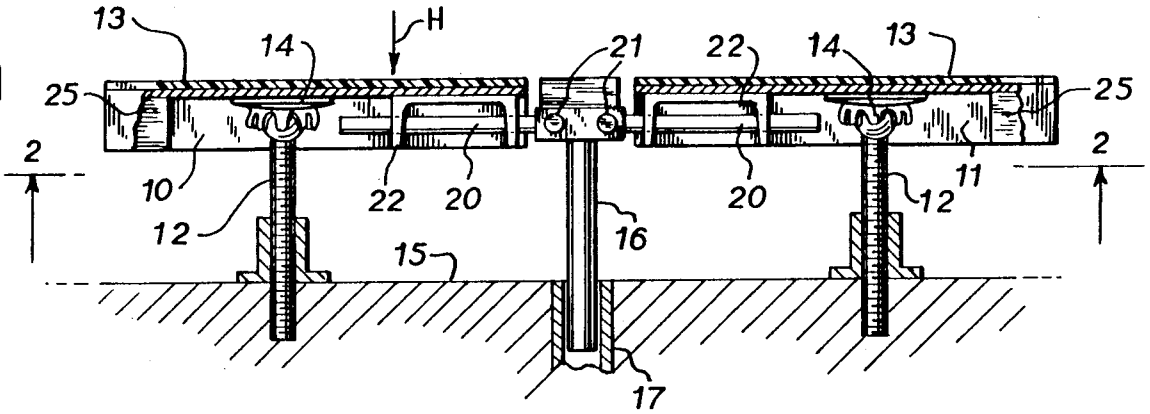
FIG. 1 is a front view in elevation of the hull support in accordance with this invention.

The support members 10 and 11 may be provided with weights 25 between their flanges at their ends outboard of the jacks 12. Proper selection of the weights will cause the hull support to assume the "at rest" position illustrated in FIG. 1 with the top of the support members 10 and 11 in a common horizontal plane.

Figure 4:
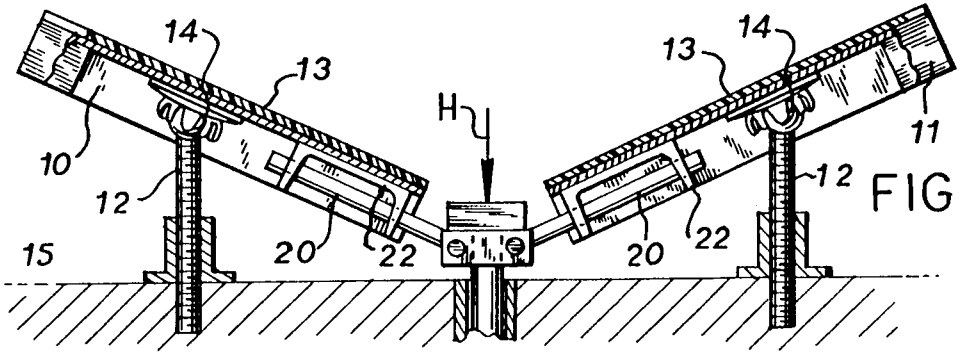
FIG. 4 is a view similar to FIG. 1 except illustrating the position of the hull support when it supports the hull of a boat.
Figure 3:
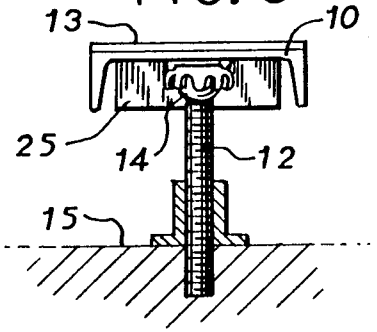
FIG. 3 is an end view in elevation of the hull support.

When the hull of a boat be lowered upon the hull support with the keel at any position between the jacks 12 (such as at the position identified by the arrow H in FIG. 1), the contacted support member 10 will tip about its ball joint 14 and this motion will be translated through a rod 20 to the guide post 16 which will be lowered into the sleeve 17. The downward movement of the guide post 16 will be translated through the second rod 20 into a corresponding tilting of the second support member 11. The guide post 16 also reacts against horizontal components of force (such as $F_x$ in FIG. 4) to laterally restrain the members 10 and 11 and other parts of the support as the hull engages the support. The result is that a natural V is formed as shown in FIG. 4 whereby the keel of the hull will slide down until it centers itself at the crook of the V. A block 25 located at the top of the guide post 16 will fill the gap between the members 10 and 11 and will support the outer most surface of the bottom of the keel.

The use of jacks 12 to support the support members 10 and 11 allows for adjustment of the vertical height of the hull support with respect to the foundation 15 to accommodate different rises in the boat hulls. A similar adjustment could be provided by a post sliding inside a pipe with the height held by a pin through the pipe and post. In lieu of a plastic sliding surface 13, a series of rollers could be mounted on the top of the support members 10 and 11 having their axes of rotation transverse to the longitudinal axis of the support members.

I claim:

1. A boat hull support, comprising;

a pair of hull support members spaced from each other and each pivotally mounted intermediate its ends to a respective upright;

a guide post mounted for vertical movement in the space between the support members; and means joining the support members to the guide post so that vertical movement of the guide post will be translated into substantially equal displacement of the support members on their pivot mountings and displacement of one of the support members will be translated into substantially equal displacement of the other support member.

2. A hull support in accordance with claim 1 wherein the joining means comprises a rod connected at one end to the guide post and slidably received in a block mounted on the support member.

3. A hull support in accordance with claim 2 wherein each rod is pivotally connected to the guide post at its said one end.

4. A hull support in accordance with claim 1 wherein weights are mounted on the ends of the support members that are remote from the guide post.

5. A hull support in accordance with claim 1 wherein the support members are mounted to the uprights by universal joints.

6. A hull support in accordance with claim 1 wherein the uprights are adjustable in length.

7. A hull support in accordance with claim 1 wherein the support members comprise elongated channels having a top surface formed with anti-friction means.

* * * * *